United States Patent [19]

Tran et al.

[11] 4,150,322

[45] Apr. 17, 1979

[54] ACCELERATING STRUCTURE FOR A LINEAR CHARGED PARTICLE ACCELERATOR

[75] Inventors: Duc Tien Tran; Dominique Tronc, both of Buc, France

[73] Assignee: CGR-MeV, Buc, France

[21] Appl. No.: 891,057

[22] Filed: Mar. 28, 1978

[30] Foreign Application Priority Data

Mar. 31, 1977 [FR] France ..... 77 09808

[51] Int. Cl.[2] ..... H01J 25/10

[52] U.S. Cl. ..... 315/5.41; 315/5.42

[58] Field of Search ..... 315/5.41, 5.42

[56] References Cited

U.S. PATENT DOCUMENTS

| | | | |
|---|---|---|---|
| 2,813,996 | 11/1957 | Chodorow | 315/5.42 |
| 3,784,873 | 1/1974 | Tronc et al. | 315/5.41 |

*Primary Examiner*—Saxfield Chatmon, Jr.

*Attorney, Agent, or Firm*—Cushman, Darby & Cushman

[57] ABSTRACT

An accelerating structure for a linear particle accelerator operating in the progressive wave mode or in the stationary wave mode and comprising at least one accelerating section and a complementary bunching or pre-accelerating section formed by a resonant cavity C of the "reentrant" type magnetically coupled with the first cavity of the accelerating section by means of a coupling iris, the cavity C having a length $L=(2m+1)\lambda_{o/4}$ and the distance D separating the interaction spaces of the cavity C and the first cavity of the accelerating section being equal to $D=(2k+n/2+\alpha)\pi-\beta\lambda_o$, with $0\leqq\alpha\leqq\frac{1}{4}$, n and k being integers, $\beta$ being the reduced velocity v/c of the particles and $\lambda_o$ being the operating wave length of the accelerator.

7 Claims, 3 Drawing Figures

ACCELERATING STRUCTURE FOR A LINEAR CHARGED PARTICLE ACCELERATOR

This invention relates to an accelerating structure intended to be used in a linear charged particle accelerator. More particularly, the invention relates to the bunching (or preaccelerating) section preceding the accelerating section of this accelerator.

In certain apparatus using particle accelerators operating at high frequencies (C or X-band for example), it can be of advantage to have a compact accelerating structure supplied with H.F. power by a single H.F. generator. However, conventional bunching means, as described for example in the U.S. Pat. No. 2,813,996, generally comprise two resonant cavities separated one from the other by a drift-tube having several wavelengths in length and means for adjusting the relative phase to the H.F. energy fed to both cavities and accelerating structure. Manufacture of such accelerators and phase adjustment of the different resonant cavities involve considerable difficulties. The accelerating structure according to the present invention enables this disadvantage to be obviated.

It is an object of the invention to provide an accelerating structure for a linear charged particle accelerator comprising at least one accelerating section formed by a series of resonant cavities coupled with one another and by a complementary cavity section situated in front of the accelerating section in the path of the beam of particles and electromagnetically coupled with the accelerating section, said cavities being provided with axial orifices for the passage of the beam of charged particles, and comprising means for injecting a hyperfrequency signal into said accelerating structure, said complementary section comprising a resonant cavity of the "reentrant" type magnetically coupled with the first cavity of the accelerating section by means of at least one coupling iris, said cavity of the "reentrant" type having a length such that the distance separating the interaction spaces of the cavity of the "reentrant" type and of the first accelerating cavity is equal to $D=(2k+n/2+\alpha)\pi\beta\lambda_o$ with $0\leqq\alpha\leqq\frac{1}{4}$, n and k being integers, $\beta$ being the reduced velocity v/c of the particles and $\lambda_o$ being the operating wave length of the accelerator.

Figure 1:
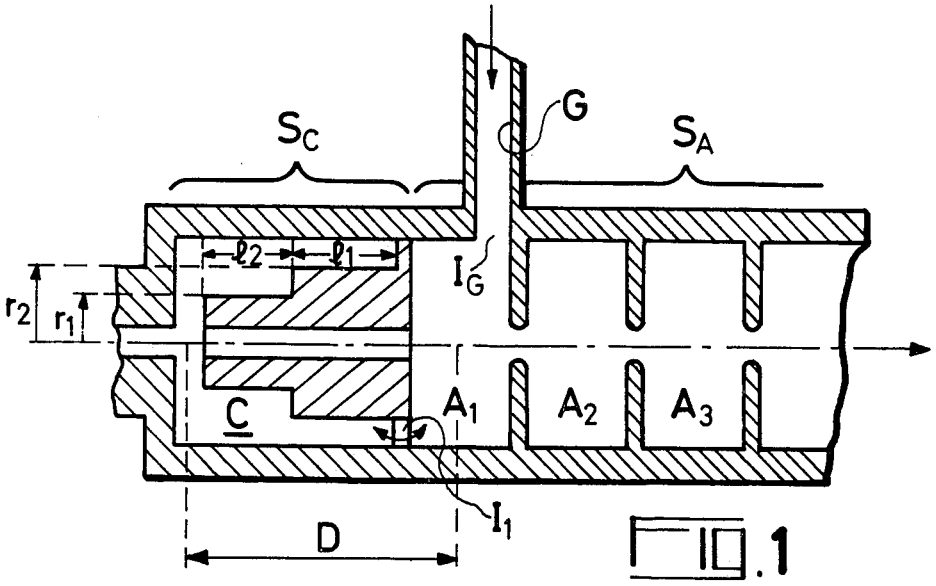
Figure 2:
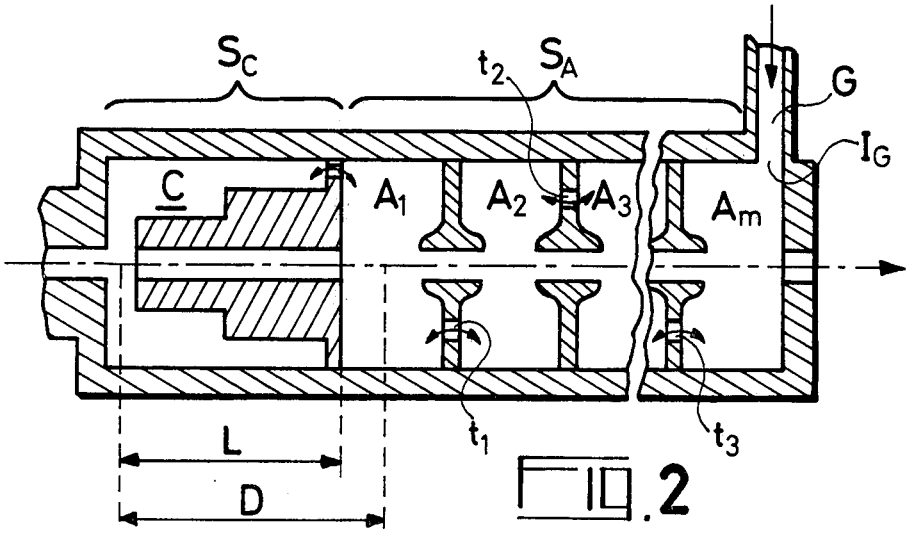
Figure 3:
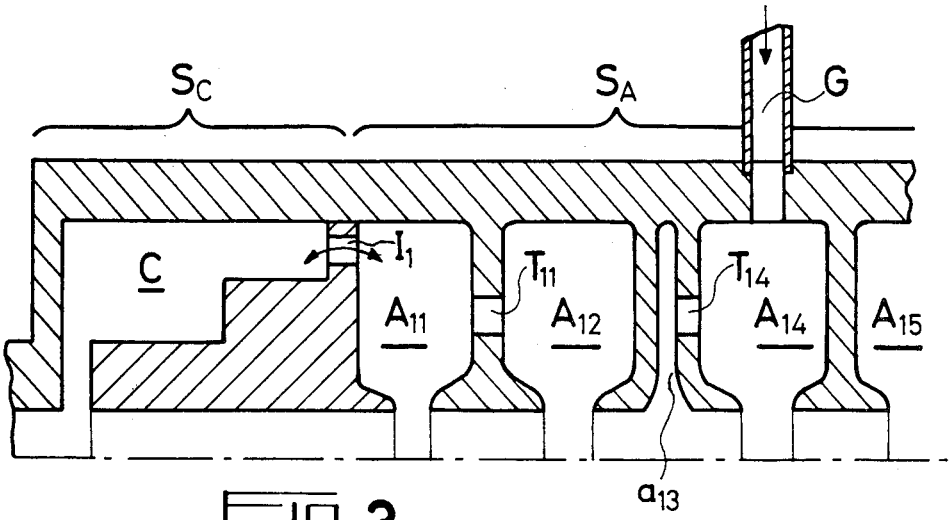

For a better understanding of the invention and to show how the same may be carried into effect, reference will be made to the drawings, given solely by way of examples which accompany the following description, and wherein:

FIGS. 1 to 3 diagrammatically illustrate three examples of embodiment of a linear accelerating structure according to the invention.

FIG. 2 shows an accelerating structure according to the invention comprising an accelerating section $S_A$ formed by a series of accelerating cavities $A_1$, $A_2$ . . . and a complementary section $S_C$ which may be a bunching section or an accelerating section, as explained hereinafter.

This complementary section $S_C$ is formed by a resonant cavity C of the "reentrant" type. In the example illustrated, the cavity C has two portions of length $l_1$ and $l_2$ having different radii $r_1$ and $r_2$, thus establishing an impedance match. In the example of embodiment shown in FIG. 1, the lengths $l_1$, $l_2$, $r_2$ have been selected such that:

$$L=l_1+l_2+r_2\simeq(2m+1)(\lambda_o/4)$$

where m is an integer at least equal to 1. The cavity C is magnetically coupled, in a direct manner, with the first cavity $A_1$ by means of a coupling iris $I_1$ formed in the thin wall of the cavity C adjacent the cavity $A_1$. The lengths $l_1$ and $l_2$ of the portions of radii $r_1$ and $r_2$ are approximately $\frac{1}{2}.\lambda_o/4$.

The centres of the interaction spaces of the cavities C and $A_1$ are separated by a distance D substantially equal to:

$$D=(2k+n/2+E)\ \pi\beta\lambda_o$$

where k and n are integers at least equal to 1 and $\alpha$ satisfies the inequality: $0\leqq\alpha\leqq\frac{1}{4}$, $\beta$ is equal to the reduced velocity v/c of the particles and $\lambda_o$ is the operating wave length in vacuo of the accelerating structure.

When $\alpha=o$ and n is an even number (for example 2), the cavity C is a preaccelerating cavity and, when $\alpha=o$ and n is an odd number, the cavity is a bunching cavity.

In this last case (m=1), during the operation of the accelerator using such a structure, the passage of the central particle of a bunch of particles through the interaction space of the reentrant cavity C takes place at the instant when the H.F. field is zero in the cavity C. The particles preceding the central particle are decelerated whilst the particles following it are accelerated, so that the beam of particles is bunched into groups.

In the case where the cavity C is used as a preaccelerating cavity, the central particle of the bunch of particles in question passes through the interaction space of the cavity C when the H.C. field is maximal.

In the two cases considered, the central particle passes through the interaction space of the accelerating cavity $A_1$ when the H.F. accelerating field is maximal.

However, the cavity C may also be determined in such a way that it acts both as a preaccelerating and a pre-bunching cavity. This is the case if, where n is an odd number (for example 1), the number $\alpha$ is selected equal to $\frac{1}{4}$. Accordingly:

$$D=(2k+\tfrac{1}{2}+\tfrac{1}{4})\pi\beta\lambda$$

If k=1, then:

$$D=(11\pi/4)\beta\lambda_o$$

In order to avoid excitation of the revolution modes in the rhumbatron cavity C, it is of advantage to couple thecavity C with the accelerating cavity $A_1$ by means of two irises $I_1$ and $I_2$ disposed symmetrically on either side of the axis of the cavity C or by means of three irises $I_1$, $I_2$, $I_3$ disposed at 120° from one another.

By way of non-limiting example, if it is desired to pre-accelerate a beam of electrons having an energy of 30 KeV in a particle accelerator operating at a frequency of 7.5 Ghz ($\lambda_o$=4 cm), the interaction spaces of the cavities C and $A_1$ may have lengths of, respectively, 6 mm and 8 mm. The particular form of the reentrant cavity C, such as shown in FIG. 1, which constitutes an impedance match to $\lambda_{o/4}$, enables the coupling magnetic field to be increased by reducing the impedance of the equivalent H.F. line and the electrical field near the axis of the structure to be increased by increasing that same impedance.

The complementary bunching and/or preaccelerating section C such as defined above may also be associated with an accelerating stationary-wave structure of the multiperiodic type. In FIG. 3, the accelerating structure $S_A$ is a triperiodic structure, such as described, for example by the Applicant in the Canadian Patent Application No. 217,902. This triperiodic structure comprising accelerating resonant cavities $A_{11}$, $A_{12}$, $A_{14}$ . . . and coupling cavities $a_{13}$ . . .

The embodiments of the invention in which an exclusive property or privilege is claimed are defined as follows:

1. An accelerating structure for a linear charged particle accelerator comprising at least one accelerating section formed by a series of resonant cavities electromagnetically coupled with one another and provided with axial orifices for the passage of the beam of particles, and a complementary cavity section disposed in front of and joined to said accelerating section in the path of said beam of particles said complementary cavity section having a common wall with the first cavity of said accelerating section, said accelerating structure further comprising means for injecting a hyperfrequency signal into said accelerating structure, said complementary section $S_C$ being formed by a resonant cavity C of reentrant type, magnetically coupled with said first cavity of said accelerating section $S_A$ by means of at least one coupling iris, said reentrant cavity C having a length such that the distance separating the interaction spaces of the reentrant cavity C and of the first cavity of the accelerating section $S_A$ is equal to $D=(2k+n/2+\alpha)\pi\beta\lambda_o$, with $0<\alpha<\frac{1}{4}$, n and k being integers, $\beta$ being the reduced velocity v/c of the particles and $\lambda_o$ being the operating wavelength of the accelerator.

2. An accelerating structure as claimed in claim 1, wherein said cavity C comprises two portions respectively having different radii $r_1$ and $r_2$, these two portions respectively having lengths of approximately $\frac{1}{2}\lambda_o/4$.

3. An accelerating structure as claimed in claim 1, wherein said cavity C is a "preaccelerating" cavity, $\alpha$ being equal to zero and n being an even number.

4. An accelerating structure as claimed in claim 1, wherein said cavity C is a "bunching" cavity, $\alpha$ being equal to zero and n being an odd number.

5. An accelerating structure as claimed in claim 1, whereub said cavity C is both a preaccelerating and a bunching cavity, n being an odd number and $\alpha$ being substantially equal to 0.25.

6. An accelerating structure as claimed in claim 1 and operating in the progressive wave mode, said cavities $A_1$, $A_2$ . . . of the accelerating section being electrically coupled with one another by means of orifices for the passage of the beam, said means for injecting the H.F. signal comprising a waveguide G magnetically coupled with said first accelerating cavity $A_1$ by means of a coupling iris $I_G$.

7. An accelerating structure as claimed in claim 1, said accelerating structure operating in the stationary wave mode.

* * * * *